US009766014B2

(12) United States Patent
Yang

(10) Patent No.: US 9,766,014 B2
(45) Date of Patent: Sep. 19, 2017

(54) GAS PURGING PLUG COMPRISING WEAR INDICATORS

(71) Applicant: VESUVIUS CRUCIBLE COMPANY, Wilmington, DE (US)

(72) Inventor: Bin Yang, Suzhou (CN)

(73) Assignee: Vesuvius Crucible Company, Wilmington, DE (US)

( * ) Notice: Subject to any disclaimer, the term of this patent is extended or adjusted under 35 U.S.C. 154(b) by 73 days.

(21) Appl. No.: 14/377,039

(22) PCT Filed: Feb. 1, 2013

(86) PCT No.: PCT/EP2013/052035
§ 371 (c)(1),
(2) Date: Aug. 6, 2014

(87) PCT Pub. No.: WO2013/117498
PCT Pub. Date: Aug. 15, 2013

(65) Prior Publication Data

US 2015/0300741 A1 Oct. 22, 2015

(30) Foreign Application Priority Data

Feb. 7, 2012 (EP) ..... 12154318

(51) Int. Cl.
*B22D 2/00* (2006.01)
*B22D 41/00* (2006.01)
(Continued)

(52) U.S. Cl.
CPC ..... *F27D 21/00* (2013.01); *B22D 1/005* (2013.01); *B22D 2/00* (2013.01); *B22D 41/00* (2013.01);
(Continued)

(58) Field of Classification Search
CPC ..... B22D 1/005; B22D 2/00; B22D 41/00; C21C 2005/448; C21C 5/48; C22B 9/05;
(Continued)

(56) References Cited

U.S. PATENT DOCUMENTS 4,385,752 A * 5/1983 Hayashi ..... B22D 1/005 266/220
5,202,079 A 4/1993 Winkelmann et al.
(Continued)

FOREIGN PATENT DOCUMENTS

DE 4419811 C1 4/1995

*Primary Examiner* — Jessee Roe
*Assistant Examiner* — Michael Aboagye
(74) *Attorney, Agent, or Firm* — Thomas Clinton; Donald M. Satina

(57) ABSTRACT

A gas purging plug for blowing gas into a metallurgical vessel, having the form of an elongated body made of a first refractory material, contains a final visual wear indicator in the form of an elongated core extending from an inlet end to a distance, along a central longitudinal axis, less than the length of the elongated body. The final visual wear indicator is made of a second refractory material that differs in visual appearance from the first refractory material between 800 and 1500 degrees C. The plug also contains an intermediate visual wear indicator extending from the inlet end to a point between the end of the final visual wear indicator and the opposite end of the elongated body. The intermediate visual wear indicator is made of a third refractory material that differs in visual appearance from the first and second refractory materials between 800 and 1500 degrees C.

12 Claims, 3 Drawing Sheets

(51) Int. Cl.

| | |
|---|---|
| ***B22D 1/00*** | (2006.01) |
| ***F27D 21/00*** | (2006.01) |
| ***C22B 9/05*** | (2006.01) |
| ***C21C 5/48*** | (2006.01) |
| *C21C 5/44* | (2006.01) |
| *F27D 3/16* | (2006.01) |

(52) U.S. Cl.
CPC ..... *C21C 5/48* (2013.01); *C22B 9/05* (2013.01); *F27D 3/16* (2013.01); *F27D 21/0021* (2013.01); *C21C 2005/448* (2013.01); *F27D 2003/161* (2013.01)

(58) Field of Classification Search
CPC ..... F27D 2003/161; F27D 21/00; F27D 21/0021; F27D 3/16
USPC ..... 266/99, 220, 265, 270
See application file for complete search history.

(56) References Cited

U.S. PATENT DOCUMENTS

| | | | | |
|---|---|---|---|---|
| 5,249,778 A | * | 10/1993 | Steichert ..... | B22D 1/005 266/220 |
| 5,279,993 A | | 1/1994 | Rothfuss et al. | |
| 5,330,160 A | | 7/1994 | Eisermann et al. | |
| 5,421,561 A | | 6/1995 | Eisermann et al. | |

* cited by examiner

GAS PURGING PLUG COMPRISING WEAR INDICATORS

BACKGROUND OF THE INVENTION (1) Field of the Invention

The present invention relates to refractory purging plugs generally used for blowing gas into a metallurgical vessel. It refers in particular to such purging plugs provided with a wear indicator informing an operator of the level of wear of the purging plug.

(2) Description of the Related Art

In metal forming processes, metal melt is transferred from one metallurgical vessel to another, to a mould or to a tool. For example a ladle is filled with metal melt out of a furnace and transferred to a tundish. The metal melt can then be cast from the tundish to a tool for forming slabs or to a mould for forming billets or ingots. In some cases, it is desirable to blow a gas into the molten metal contained in such metallurgical vessels. This can be useful to accelerate the homogenization of the temperature and composition of a bath, to carry non metallic inclusions present in the bulk of the bath up into the slag top layer, to create favourable conditions within the molten metal, and the like. The gas is generally blown into the molten metal by means of purging plugs located at the bottom or side of a metallurgical vessel such as a ladle or a tundish.

Purging plugs are in the form of a block of refractory material, generally extending along a longitudinal axis. At one end of the block, a gas inlet connected to a source of pressurized gas is fluidly connected to a gas outlet at the opposite end of the block. The gas inlet and gas outlet may be fluidly connected to one another through an open pore network, by one or more channels (e.g., slit shaped or with circular cross-section), or a combination of both. An open pore network is sometimes said to yield "indirect permeability," whilst a channel is said to yield "direct permeability." It is generally recognized that direct permeability plugs are more efficient than indirect permeability plugs, mostly because a pore network comprises an uncontrollable tortuosity which affects negatively the permeability of the plug, whilst the size and geometry of a manufactured channel can be controlled such as to minimize tortuosity, and therefore increase the permeability compared with pores of same equivalent diameter or dimensions.

As illustrated in FIG. 1, a purging plug (1) is usually embedded in the wall and lining of a metallurgical vessel (31), with the gas inlet facing the exterior side of the metallurgical vessel, and with the gas outlet facing the inside of the vessel, in contact with the molten metal. The terms "gas inlet" and "gas outlet" are defined with respect to the flow direction (11) of the gas being injected into the metallurgical vessel. Because of their structure and extreme working environment, purging plugs wear more quickly than the refractory liner of the vessel, with severe erosion of the order of several mm or even cm after each use. This means that during the lifetime of a metallurgical vessel such as a ladle, gas plugs need be changed several times. The changing of a gas plug takes time, is work intensive, and requires the purchase of a new plug each time, so that operators tend to push the use of a plug as long as possible to extend the intervals between plug changes. One major danger with pushing the use of a plug too long, is that if the erosion of the plug is too deep, the remaining base of the plug may be unable to resist the pressure of the molten metal and may leave a gaping hole whence molten metal may flow out freely. If this happens during transfer of the ladle towards a tundish, it may spray molten metal at temperatures of the order of 1400° C. all over the workshop with dramatic consequences. To avoid this to happen, wear indicators have been proposed in the art, informing the operator of the degree of erosion undergone by a purging plug, who can decide whether it could be used again or not.

U.S. Pat. No. 5,202,079 proposes an indirect permeability type plug (i.e., wherein the gasflow path is defined by the porosity of the plug) comprising an outer body defining the external geometry of the plug, said outer body being made of a non-porous refractory material, and an inner core made of a refractory material of higher porosity, allowing gas to flow from an inlet to an outlet of the plug. The transverse cross section of the porous core, normal to the longitudinal axis of the plug, varies along said longitudinal axis. When a metallurgical vessel is emptied of its molten metal load, gas is injected through the plug as it is still hot, and the gas flowing out of the hot plug into the interior of the empty vessel will glow defining the shape of the porous core cross-section exposed to the interior of the vessel giving the operator an indication on the level of erosion of the plug depending on the shape of the glowing section. This system, however, is restricted to indirect permeability type plugs, and reduces the efficacy of the plug by restricting the gas flow path to the inner core of the plug. Another disadvantage of this type of plug is the cooling effect of the gas. The plug gets colder. This increases the wearing but also the risk of metal freezing and clogging of the plug.

Similarly, U.S. Pat. No. 4,385,752 discloses porous plugs comprising a porous outer body and a porous inner core having a different emissivity than the refractory of the outer body. The principle is therefore quite similar to the previous document, with the difference that the outer body is also porous, thus increasing the efficacy of the plugs with respect to the one disclosed in U.S. Pat. No. 5,202,079. This solution is, however, also restricted to porous plugs only.

U.S. Pat. No. 5,249,778 extends the principle disclosed in the former two documents to direct permeability plugs, by providing a plug with one or more channels extending from a gas inlet to a gas outlet, and further including a porous insert in fluid communication with the gas inlet, and extending along the longitudinal axis of the plug up to the height corresponding to, or nearly to the end of use of the plug. When erosion reaches the porous insert, gas flowing through the porous insert will cool the refractory centre quicker than the periphery, thus creating a dark spot at the centre indicative of the end of the plug's service life. Each of the foregoing plugs require gas to be injected through the plug when the vessel is empty, and therefore not necessarily close to a connection to a gas source. The cooling of the plug leads to the drawbacks above mentioned.

U.S. Pat. No. 5,330,160 discloses a purging plug comprising an insert made of a material having a lower melting point than the metal contained in the vessel, said insert being inserted into a cavity extending from the plug top (which is to contact the molten metal) down to a level of plug considered as indicative of the end of the service life thereof. The low melting point insert can extend up to and is flush with the top end of the plug, or end to a level lower than said top end, the top of the cavity being filled with a top cap made of a high wear resistant refractory material. When the top cap is worn out and the top of the low melting temperature material contacts the molten metal to be cast, the low melting temperature material melts and is replaced in the cavity by molten metal to be cast. When the vessel is emptied, some metal remains in the cavity and glows forming a "magic eye" clearly visible by an operator. When the erosion of the plug reaches the bottom of the cavity, the magic eye disappears and the operator is thus informed that the plug should be replaced. In a variation of the former plug, U.S. Pat. No. 5,421,561 discloses a plug wherein the low melting temperature insert is enclosed in a non-metallic tube acting as thermal insulator to further enhance the glow of the "magic eye". The manufacturing of such plug is rather work intensive, as a cavity needs be drilled into the body of the plug and the insert inserted therein, whilst the space between the cavity walls and the insert must be decreased. One wonders whether the low melting temperature visual wear indicator is needed at all, since all is required is a cavity. Furthermore, this system provides a binary signal, indicative that the plug can be used as long as the magic eye is visible, but it does not inform the operator on the erosion rate of the plug. In practice, to be on the safe side, the operators replace the plug when the magic eye appears.

The present invention proposes a solution allowing to estimate the erosion rate of the plug, which is very easy and relatively cheap to manufacture.

SUMMARY OF THE INVENTION

The present invention is defined by the attached independent claims. The dependent claims define preferred embodiments. In particular, the present invention concerns a gas purging plug for blowing gas into a metallurgical vessel comprising:

1. (a) An elongated body made of a first refractory material and extending from a first, inlet end to a second, outlet end over a distance, H, measured along a central longitudinal axis comprising,
2. (b) At least one gas flow path fluidly connecting a gas inlet located at said first inlet end of said elongated body to a gas outlet, located at the opposite second, outlet end;
3. (c) A final visual wear indicator in the form of an elongated core extending from the first inlet end (2*a*) to a first distance, h1, measured along the central longitudinal axis, which is less than the length, H, of the elongated body, h1<H, said final visual indicator being made of a second refractory material of different visual appearance than the first refractory material at least at a temperature comprised between 800 and 1500° C., Characterized in that, it further comprises an intermediate visual wear indicator, partially embedded in the final visual wear indicator and extending from an initial distance, h0, to a final distance, h2, from the first, inlet end, wherein h0<h1<h2<H, and wherein the intermediate visual wear indicator is made of a third material, permitting to yield or presenting a different visual appearance than the first and second refractory materials at least at a temperature comprised between 800 and 1500° C.

It is clear that it can be advantageous if the second refractory material of the final visual wear indicator and the third material of the intermediate wear indicator are selected such as to permit to yield a different visual appearance with the first refractory material of the body at temperatures beyond, in particular below, 800 to 1500° C., but since it is desired to have an indication of the level of erosion of the plug without having to cool the vessel down, in most cases it suffices that the visual differences between materials appear in that temperature range.

The third material of the intermediate visual wear indicator may be a metal, preferably steel, more preferably carbon steel or stainless steel, which at least partly melts in contact with the molten metal to be cast, such that, after emptying of the vessel, leaves some of said metal to be cast in the cavity formed by the removal of the metal visual indicator. Alternatively, the third material of the intermediate visual wear indicator may be a refractory material, preferably selected from the group of silicon carbide, magnesite, alumina, castable $Al_2O_3$—$SiO_2$, Al2O3, spinel, Al—C, Mg—Cr, preferably Al—C, as long as it yields a different visual appearance from the first and second refractory materials of the plug body and of the final visual wear indicator, respectively, at least at a temperature comprised between 800 and 1500° C. For better visibility, it is recommended to use an indicator made of metal. The glowing of the metal is clearly visible and eases the job of the operator.

The second refractory material of the final visual wear indicator may be selected from the group of silicon carbide, magnesite, alumina, castable $Al_2O_3$—$SiO_2$, Al2O3, spinel, Al—C, Mg—Cr, preferably Al—C, as long as it yields a different visual appearance from the first and, if it applies, the third refractory materials of the plug body and of the intermediate visual wear indicator, respectively, at least at a temperature comprised between 800 and 1500° C.

The length, h2–h0, of the intermediate visual wear indicator may be equal to or greater than 25 mm and less than or equal to 150 mm, is preferably comprised between 25 and 150 mm, more preferably between 30 and 100 mm, most preferably, between 40 and 70 mm. The height, h2, between the plug base and the top of the intermediate wear indicator may be equal to or less than 400 mm, is preferably not more than 400 mm, more preferably not more than 300 mm, most preferably not more than 200 mm. The height, h1–h0, of the portion of the intermediate visual wear indicator embedded in the final visual wear indicator is preferably comprised between 10 and 75 mm, more preferably, between 15 and 50 mm, most preferably between 20 and 30 mm. Between 20 and 80% of the length of the intermediate visual wear indicator is preferably embedded in the final visual wear indicator; preferably, 40 to 60% of the length thereof is embedded and, more preferably about half of the intermediate visual wear indicator is embedded in the final visual wear indicator. The lower level, h0, reached by the intermediate visual wear indicator may be of the order of 100 to 150 mm, preferably 105 to 140 mm, more preferably between 120 and 130 mm.

To further enhance the visual differences between the two, the intermediate and final visual wear indicators may have a cross-section normal to the central longitudinal axis (X1) of different shapes. In case the intermediate visual wear indicator is made of an electrical conductor, such as a metal, an electric circuit may advantageously be connected to two distinct points of the intermediate indicator, at predetermined heights. A light bulb, LED or the like can be connected to said circuit. When the erosion of the plug reaches the highest electric connection, the circuit is disrupted and the light corresponding to said point switches off, indicating the operator, even before the vessel is emptied, that a certain level of erosion has been reached. This embodiment is particularly suitable for vessels which, contrary to e.g., ladles, are not emptied regularly. For instance, it can give an indication of the level of erosion of a purging plug mounted on a tundish even without emptying the tundish.

The purging plug of the present invention can be a direct permeability type plug, wherein the gas flow path is in the shape of one or several slots extending from the inlet end to the outlet end of the plug or may alternatively be of the indirect permeability type, wherein the gas flow path is defined by the open porosity of the first refractory material making the body of the plug.

The present invention also concerns a metallurgical vessel comprising a gas purging plug as discussed above, with the gas outlet of the gas purging plug being in fluid communication with the interior of said vessel. The vessel can be for example a ladle or a tundish.

BRIEF DESCRIPTION OF THE FIGURES

Various embodiments of the present invention are illustrated in the attached Figures.

DETAILED DESCRIPTION OF THE INVENTION

Figure 1:
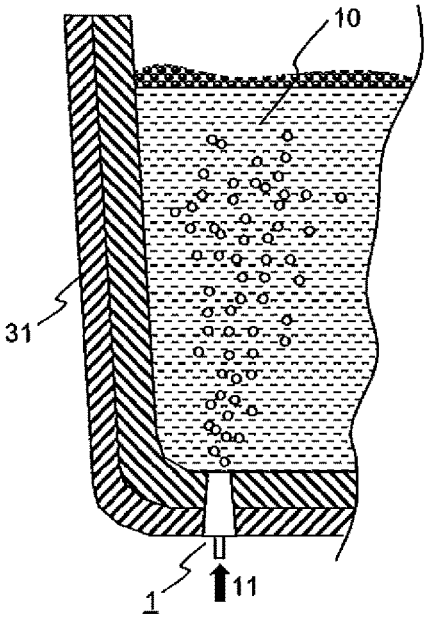
FIG. 1: shows a purging plug mounted on the bottom floor of a metallurgical vessel.
Figure 2:
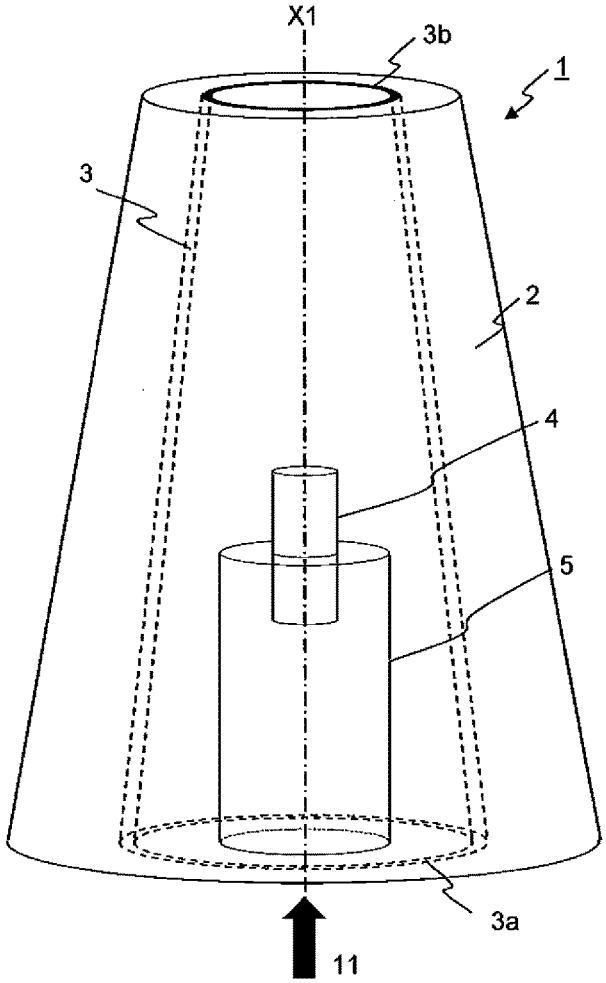
FIG. 2: shows a perspective view of a purging plug according to the present invention showing the intermediate and final visual wear indicators.

As can be seen in FIG. 2, a purging plug (1) according to the present invention comprises a body extending along a longitudinal axis (X1) between a gas inlet (3*a*) at a first end of said body and a gas outlet (3*b*) at the opposite end of said body, along said longitudinal axis, the gas inlet (3*a*) being in fluid communication with the gas outlet (3*b*) via at least one gas flow path. The body is made of a first refractory material. A slit shaped gas flow path (3) is illustrated in FIG. 2, defining a direct permeability type plug. In such embodiment the first refractory material of the plug body (1) is substantially non-porous, or at least does not have an open porosity able to form a continuous gas flowpath extending from the gas inlet (3*a*) to the gas outlet (3*b*) of the plug. The present invention can also be applied to indirect type plugs, wherein the gas flow path is defined by the open porosity of the first refractory material constituting the body of the plug. A frustoconical body is illustrated in the Figures, but it is clear that the present invention is independent of the outer geometry of the purge body (1), as long as a first longitudinal axis (X1) can be defined.

A plug according to the present invention comprises at least two visual wear indicators (4, 5) arranged such that they can inform an operator on at least four different levels of erosion of the plug. In particular, it comprises a final visual wear indicator (5) in the form of an elongated core extending from the first inlet end (2*a*) to a first distance, h1, measured along the central longitudinal axis (X1), which is less than the length, H, of the elongated body, h1<H. The final visual indicator is made of a second refractory material of different visual appearance than the first refractory material at least at a temperature comprised between 800 and 1500° C. The final visual wear indicator (5) of the present invention may be made of a porous second refractory material as disclosed in U.S. Pat. No. 4,385,752, and even comprising the same material as the non-porous first refractory material of the body, but with a higher porosity as disclosed in U.S. Pat. No. 5,249,778. A porous visual indicator requires gas injection therethrough to create a visual contrast indicative of the level of erosion. Since the cooling effect of the gas is not desired and a source of gas is not necessarily available when the vessel is empty, it is preferred that the visual appearance between the final visual indicator and the first refractory material of the body be sufficiently different without the need of blowing gas through the plug. For instance, the first and second refractory materials may have different colours, quite visible with a naked eye and the final visual wear indicator (5) needs not be porous. It is preferred that the visual wear indicator be visible without having to cool the vessel, so that the visual appearance between the first and second refractory materials should be different at least at a temperature comprised between 800 and 1500° C. It is clear that if the two materials show a different appearance at lower temperatures, it is even better, but in most cases, it suffices that the contrast be visible at high temperatures.

The final visual wear indicator (5) extends up to a height, h1, of the plug measured from the plug base (2*a*) along the longitudinal axis (X1), which is higher than the lowest admissible level, h0, of erosion of the plug. It can be made of any of the following materials: silicon carbide, magnesite, alumina, castable $Al_2O_3$—$SiO_2$, Al2O3, spinel, Al—C, Mg—Cr. The final visual wear indicator (5) is preferably made of Al—C.

Figure 3:
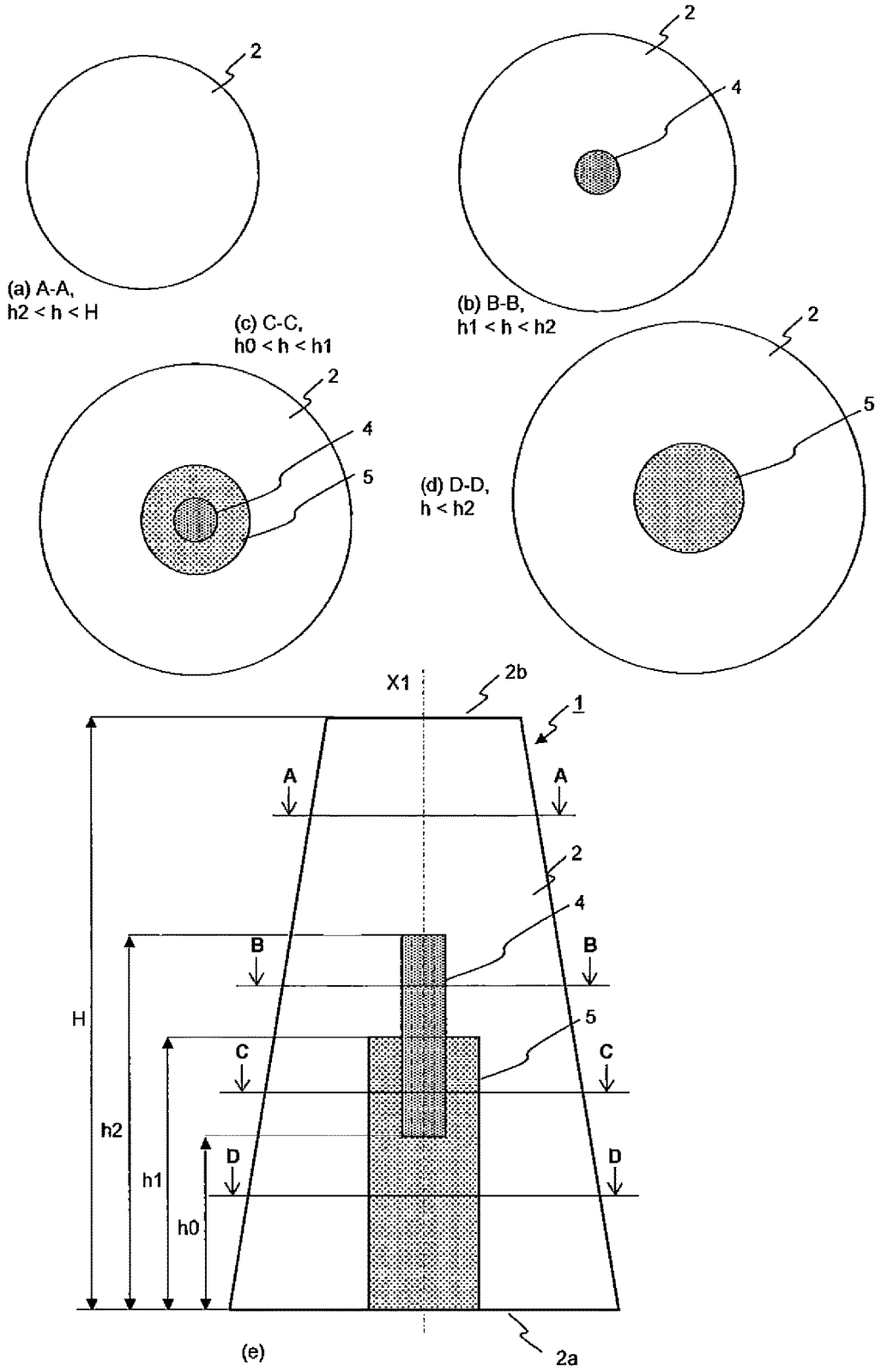
FIG. 3: shows various transverse cuts of a plug at different levels thereof, illustrating the visual appearance of the plug depending on the level of erosion of the plug.

The purging plug of the present invention comprises an additional, intermediate visual wear indicator (4) made of a third material different from the first and second refractory materials of the plug body (1) and the final visual erosion indicator (5). The third material of the intermediate visual wear indicator (4) must be such that when exposed by erosion, the plug seen from above (i.e., from the interior of the vessel) yields a different visual appearance at the surrounding body (1), at the intermediate visual wear indicator (4), and at the final visual wear indicator (5) when exposed. As illustrated in FIGS. 2 and 3(*e*), the intermediate visual wear indicator (4) is in the form of an elongated rod, partially embedded in the final visual indicator (5) with a portion thereof protruding out of it. The intermediate visual wear indicator (4) extends from a height, h0, defining a height equal to or slightly above the maximum level of erosion tolerated by the plug, to a height, h2, from the base (2*a*) of the plug, wherein, h0<h1<h2<H, wherein H is the total height of the plug.

This arrangement takes full advantage of the two visual wear indicators, as it permits four levels of erosion to be identified. As illustrated in FIGS. 3(*a*)-(*d*), when the erosion reaches a height, h, of the plug which is above h2 (=the highest point of the intermediate visual wear indicator), the top surface of the plug as can be seen by an operator observing from above the empty vessel appears like a homogeneous surface of the first refractory material of the plug body (2), as shown in FIG. 3(*a*) (cut A-A). When the erosion reaches a height comprised between h2 and h1 (=highest point reached by the final visual wear indicator), the operator can see the cross section of the intermediate visual wear indicator (4) enclosed in the first refractory material of the plug body (2), as shown in FIG. 3(*b*) (cut B-B). When erosion proceeds further between h1 and h0 (=bottom end of the intermediate visual wear indicator), the operator can see three different portions: the surrounding body (2) enclosing the cross section of the final visual wear indicator (5), which itself encloses the intermediate visual wear indicator (4), as shown in FIG. 3(*c*) (cut C-C). Finally, when the erosion proceeds below h0, the visual appearance of the top surface of the plug consists simply of the second refractory material of the final visual wear indicator (5) embedded in the surrounding plug's first refractory material (2), as shown in FIG. 3(*d*) (cut D-D). At this point, the plug cannot be used further, least it would wear off completely during the next operation, leaving a gaping hole where the plug should be.

The intermediate visual wear indicator (4) can be made of a third refractory material selected out of the same list of materials presented for the second refractory material of the final visual wear indicator (5), as long as it yields a visual appearance at least in a temperature range comprised between 800 and 1500° C., which is different, on the one hand, from the first refractory material of the body (2) of the plug, so that an erosion of the plug to a height comprised between h2 and h1 can readily be spotted by visual observation and, on the other hand, from said second refractory material, so that an erosion of the plug between h1 and h0 can be identified. The third refractory material can be the same as the first refractory material of the plug body, but with a higher porosity, allowing gas to flow therethrough when the top surface of the intermediate visual wear indicator is exposed to ambient by erosion, and thus cool at a quicker rate than the surrounding body, yielding a darker colour than the latter. Alternatively, the third refractory material can as such be visually distinct from the first and second refractory material. It can for instance be loaded with a pigment, such as carbon black or titanium dioxide, giving a colour different from the first and second refractory materials.

In an alternative embodiment, the intermediate visual wear indicator can be made of a third material which is not refractory and which actually has a melting temperature lower than the temperature of the molten metal to be contained in the vessel. When the erosion of the plug reaches a height of h2, thus exposing the top of the intermediate visual wear indicator (4) to contact with the molten metal at a temperature higher than the melting temperature of the third material, the intermediate visual wear indicator will melt and the cavity left by the molten intermediate visual wear indicator gets filled by the molten metal contained in the vessel. After emptying the vessel, some metal remains in the cavity forming the "magic eye" reported in U.S. Pat. No. 5,330,160. It should be stressed that the final visual wear indicator (5) shall never be made of a low melting temperature material else, upon eroding the plug down to a height h1; the molten metal contacting the top of the final visual wear indicator (5) would melt it and fill the cavity left by it which extends down to the base (2*a*) of the plug, and flow out of the vessel with dramatic consequences.

The third, low melting temperature material of the intermediate visual wear indicator can be selected from the group of soapstone, calcium silicate, talcum, or metal. In a preferred embodiment of the invention, the intermediate visual wear indicator is made of metal, preferably steel, such as carbon steel or stainless steel. The expression "low melting temperature material" is used here to refer to materials having a melting temperature lower than the temperature of the molten metal contained in the vessel.

Alternatively, the material of the intermediate visual wear indicator does not necessarily present a melting temperature lower than the temperature of the molten metal contained in the vessel. In such a case the material is such that it melts during the cleaning of the plug by oxygen lancing. The cleaning of the plug by oxygen lancing is not always necessary but it helps to better identify the different wear indicators and/or melt some of them.

The intermediate and final visual wear indicators (4, 5) are in the shape of an elongated prism, of any cross sectional geometry: their cross section may be round, to yield a cylinder, or may be polygonal. If the cross sectional geometries of the intermediate and final visual wear indicators are different from one another, say one is square and the other round, the visual contrast between the two can be even more striking, and any confusion between an erosion down to the height comprised between h2 and h1 (i.e., where the intermediate visual wear indicator (4) alone is exposed) and an erosion down to below h0 (i.e., where the final visual wear indicator (5) alone is exposed) can thus be avoided.

The intermediate wear indicator (4) typically has a length comprised between 25 and 150 mm, preferably between 30 and 100 mm, more preferably, between 40 and 70 mm. Between 20 and 80% of its length is preferably embedded in the final visual wear indicator (5), more preferably between 40 and 60% of its length, and more preferably, about half of the intermediate visual wear indicator (4) is embedded in the final visual wear indicator (5). A plug can safely be used until at least 100 mm of the plug remains un-eroded. For this reason, the lowest point, h0, reached by the intermediate visual wear indicator (4) should be slightly greater than 100 mm, and is preferably comprised between 105 and 150 mm, preferably between 110 and 130 mm.

Figure 4:
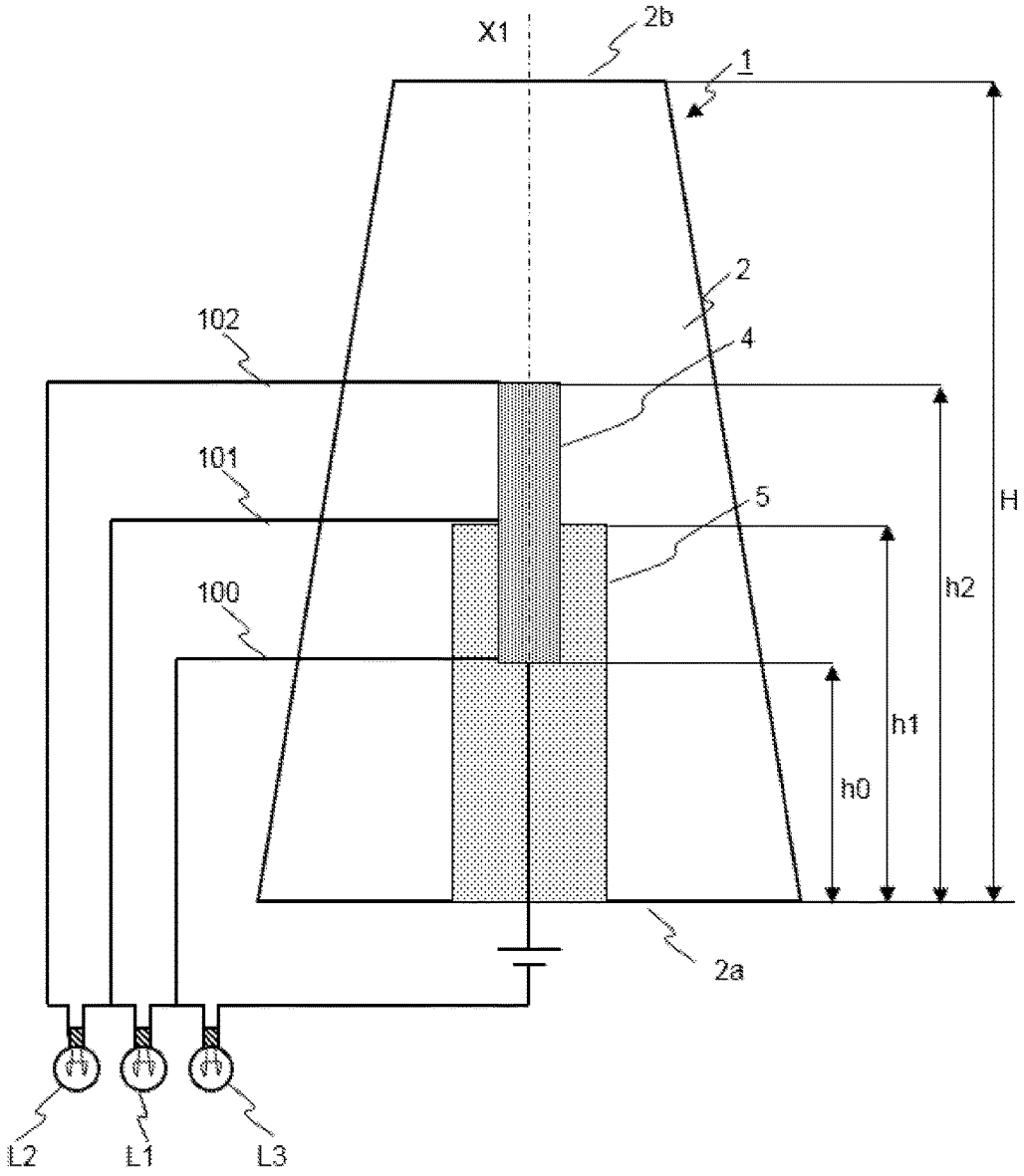
FIG. 4; shows a preferred embodiment of the invention with light indicators of the level of wear of the plug.

If the intermediate visual wear indicator (4) is made of an electric conducting material, such as a metal, it can be advantageous to define an electric circuit (100, 101, 102) connected to at least two distinct points of said intermediate visual wear indicator (4) and further comprising a light (L1, L2, L3) indicating whether the circuit is still operational or is disrupted by the erosion of the plug. FIG. 4 shows an example of such embodiment, wherein three parallel circuits are all connected to the lowest point of the intermediate visual wear indicator (4) at a height h0, and to three points at different levels of the indicator, a first circuit (102) at the top, h2, of the indicator, a second (101) at the height, h1, where the intermediate and final visual wear indicators (4, 5) meet, and a third (100) at the bottom, h0, of the indicator (4) but separated from the first connection. Three lights (L1, L2, L3) are connected to each parallel circuit and are lit as long as the circuits are operational. When the erosion reaches the height h2 at the top of the intermediate visual wear indicator (4), the electric circuit (102) is disrupted and the light (L2) goes off indicating that erosion has reached the height, h2. As erosion reaches the height h1, the second electric circuit (101) gets disrupted and the light (L1) goes off indicating the erosion reached the level h1. Finally when the erosion reaches the bottom of the intermediate visual wear indicator (4) at height h0, the third light (L3) goes off as the electric circuit (100) is disrupted. Of course, each parallel circuit can be connected to an electrical switch instead of a light, the switch being kept open as long as current can flow in each electric circuit (100, 101, 102). Each switch is connected to a second circuit comprising a light. When a circuit connection to the intermediate visual wear indicator is disrupted by erosion, the corresponding switch closes the second circuit, lighting the corresponding light. Such external light indicator can be very useful for monitoring the level of erosion of a plug coupled to a metallurgical vessel which is not emptied at short intervals like for example in a tundish. The operator can thus be warned of a dangerous level of erosion of the plug before the tundish has been emptied.

The purging plugs described above comprise only an intermediate and a final visual wear indicators (4, 5), the former being partly embedded in the latter. It is clear that an additional, third or even a fourth wear indicators can likely be partly embedded in one another, thus giving a finer reading of the erosion rate of the plug. It is believed, however, that a dual indicator plug according to the present invention will fulfil the needs in most applications where such plugs are being used.

A purging plug according to the present invention can be manufactured very easily and economically. A dual-indicator unit is first manufactured. An intermediate visual wear indicator (4) in the form of an elongated rod or prism, can be placed standing at the bottom of a tool into a cavity of depth corresponding to the portion of the intermediate visual wear indicator (4) sticking out of the final visual wear indicator (5). A slip of the second refractory material is then cast over the rod and is at least partially hardened. Alternatively, a slip of the second refractory material is cast in a prismatic (preferably cylindrical) tool and while still viscous, an elongated rod or prism in a third material is partly submerged into said slip, which is then, at least partially hardened. If an electric circuit is used, the wiring can be embedded in the final visual wear indicator (5) during manufacturing of the dual indicator unit.

The partly hardened dual-indicator unit is then positioned at the bottom of a tool for producing the plug's body (2). If the plug is of the direct permeability type tool, foils of a material degrading at the firing temperature should be positioned where the slits are to be arranged. A slip of the first refractory material is then cast over the dual-indicator unit to form the plug's body (2) and the tool can be heated to fire both first and second refractory materials. After firing, the plug can be demoulded and the final process steps can be carried out as well known by any person in the art. Alternatively, the plug can be cast directly into its metallic casing. The heat treatment and process steps can be easily adapted by the person skilled in the art.

A purging plug according to the present invention gives information on at least four levels of erosion of the plug (as illustrated in FIG. 3) by using a simple dual-indicator unit, comprising an intermediate visual wear indicator (4) partly embedded in a final visual wear indicator (5). The simple design of the plug is very easy and economical to produce, quite like a standard plug with no indicator, requiring no labour intensive machining step to drill a cavity to insert a rod therein as in U.S. Pat. No. 5,330,160 or in U.S. Pat. No. 5,421,561. It allows the implementation of a "magic eye" as described in the foregoing documents, with additional functionalities and in a simpler way to produce. The present invention can be implemented in purging plugs of the direct and indirect permeability types alike.

Numerous modifications and variations of the present invention are possible. It is, therefore, to be understood that within the scope of the following claims, the invention may be practiced otherwise than as specifically described.

The invention claimed is:

1. Gas purging plug for blowing gas into a metallurgical vessel comprising:

(a) An elongated body made of a first refractory material and extending from a first, inlet end to a second, outlet end over a distance, H, measured along a central longitudinal axis comprising, (b) At least one gas flow path fluidly connecting a gas inlet located at said first inlet end of said elongated body to a gas outlet located at the opposite second, outlet end;

(c) A final visual wear indicator in the form of an elongated core extending from the first inlet end to a first distance, h1, measured along the central longitudinal axis, which is less than the length, H, of the elongated body, said final visual indicator being made of a second refractory material of different visual appearance than the first refractory material at least at a temperature comprised between 800 and 1500° C., wherein the gas purging plug further comprises an intermediate visual wear indicator, partially embedded in the final visual wear indicator and extending from an initial distance, h0, to a final distance, h2, from the first, inlet end, wherein h0<h1<h2<H, wherein the intermediate visual wear indicator is made of a third material, presenting a different visual appearance than the first and second refractory materials at least at a temperature comprised between 800 and 1500° C., and wherein between 20% and 80% of the length of the intermediate visual wear indicator is embedded in the final wear indicator.

2. Gas purging plug according to claim 1, wherein the third material of the intermediate visual wear indicator comprises a metal.

3. Gas purging plug according to claim 1, wherein the third material of the intermediate visual wear indicator comprises a refractory material.

4. Gas purging plug according to claim 3, wherein the third material of the intermediate visual indicator is selected from the group consisting of silicon carbide, magnesite, alumina, castable $Al_2O_3$—$SiO_2$, $Al_2O_3$, spinel, Al—C, and Mg—Cr.

5. Gas purging plug according to claim 1, wherein the second refractory material of the final visual wear indicator is selected from the group consisting of silicon carbide, magnesite, alumina, castable $Al_2O_3$—$SiO_2$, $Al_2O_3$, spinel, Al—C and Mg—Cr, and wherein the second refractory material of the final visual wear indicator is different from the intermediate visual wear indicator.

6. Gas purging plug according to claim 1, wherein the length, h2−h0, of the intermediate visual wear indicator is equal to or greater than 25 mm and less than or equal to 150 mm.

7. Gas purging plug according to claim 1, wherein the height, h2, between the plug base and the top of the intermediate wear indicator is equal to or less than 400 mm.

8. Gas purging plug according to claim 6, wherein the length, h1−h0, of the portion of the intermediate visual wear indicator embedded in the final visual wear indicator is equal to or greater than 10 mm and equal to or less than 75 mm.

9. Gas purging plug according to claim 1, wherein the intermediate and final visual wear indicators have a cross-section normal to the central longitudinal axis (X1) of different shapes.

10. Gas purging plug according to claim 1, wherein said at least one gas flow path is in the shape of one or several slots extending from the inlet end to the outlet end of the plug.

11. Gas purging plug according to claim 1, wherein said at least one gas flow path is defined by the open porosity of the first refractory material making the body of the plug.

12. Gas purging plug according to claim 1, wherein the intermediate visual wear indicator is made of an electric conductive material, and wherein an electric circuit is defined between two distinct points of the intermediate visual wear indicator at a level comprised between h0 and h2, and wherein said electrical circuit further comprises a light indicator connected thereto.

* * * * *